United States Patent [19]

Mariano et al.

[11] Patent Number: 4,550,534

[45] Date of Patent: Nov. 5, 1985

[54] ATTIC STAIRCASE

[76] Inventors: Kenneth E. Mariano, c/o George Spector, 3615 Woolworth Bldg.; George Spector, 3615 Woolworth Bldg., both of 233 Broadway, New York, N.Y. 10007

[21] Appl. No.: 525,736

[22] Filed: Aug. 23, 1983

[51] Int. Cl.[4] ..... E06C 9/06; E06B 5/00; E04D 13/035

[52] U.S. Cl. ..... 52/19; 49/386; 52/72; 182/81

[58] Field of Search ..... 52/19, 72; 49/379, 386; 182/81; 292/87; 220/315, 324, 326

[56] References Cited

U.S. PATENT DOCUMENTS 2,604,675 7/1952 Seaman ..... 49/386 X 2,725,003 11/1955 Lyons ..... 52/19

3,807,528 4/1974 Frank ..... 182/81

3,896,595 7/1975 Anghinetti et al. ..... 52/72

4,180,142 12/1979 Sevillano et al. ..... 182/81 X

*Primary Examiner*—J. Karl Bell

[57] ABSTRACT

A sealing cover for an attic floor well opening and attic stairs is provided and consists of a dome made of insulated material, a seal made of weather stripping mounted around bottom edge of the dome, a device for holding down the dome over the attic floor well opening and compressing the seal around perimeter of the attic floor well opening making the dome draft free and another device for raising up the dome from the attic floor well opening so that a person may gain access through the attic floor well opening via the attic stairs.

3 Claims, 5 Drawing Figures

ATTIC STAIRCASE

BACKGROUND OF THE INVENTION

The instant invention relates generally to staircase covers and more specifically it relates to a sealing cover for an attic floor well opening and attic stairs.

With the increasing costs for heating and cooling buildings conserving the use of fuel is needed. A good deal of fuel is wasted when there is a draft from the attic of a building. Heat will rise and exit through the roof in winter. In summer a heated roof will make the temperature rise in the attic and thus the building. This situation is not desirable so accordingly it is in need of an improvement.

Numerous staircase covers have been provided in prior art, that are adapted to be placed over an opening. For example, U.S. Pat. Nos. 568,704 and 3,807,528 are illustrative of such prior art. While these units may be suitable for the particular purpose to which they address, they would not be as suitable for the purposes of the present invention as heretofore described.

SUMMARY OF THE INVENTION

A principle object of the present invention is to provide a sealing cover for an attic floor well opening and attic stairs that has a device for holding down a dome over the attic floor well opening compressing a seal around perimeter of the attic floor well opening making the dome draft free.

Another object is to provide a sealing cover for an attic floor well opening and attic stairs that has a device for raising up the dome from the attic floor well opening so that a person may gain access through the attic floor well opening via the attic stairs.

An additional object is to provide a sealing cover for an attic floor well opening and attic stairs that has a dome made of insulated material and a seal made of weather stripping.

A further object is to provide a sealing cover for an attic floor well opening and attic stairs that is simple and easy to use.

A still further object is to provide a sealing cover for an attic floor well opening and attic stairs that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
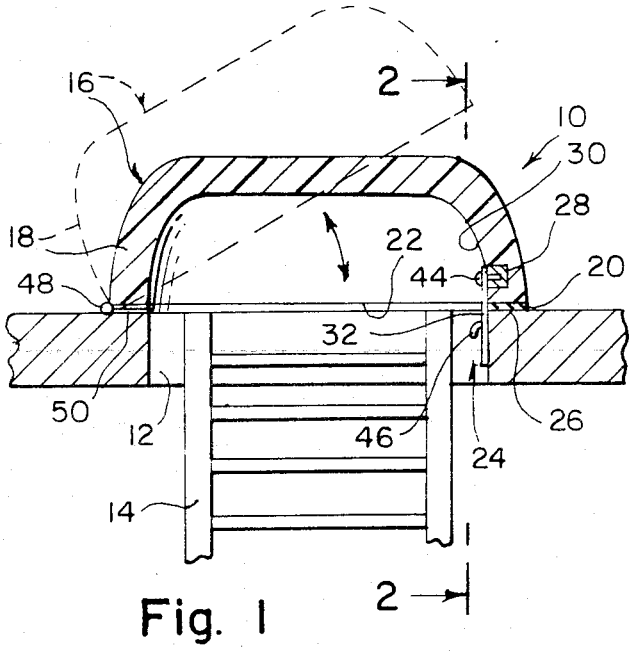
FIG. 1 is a cross sectional view of the invention.
Figure 2:
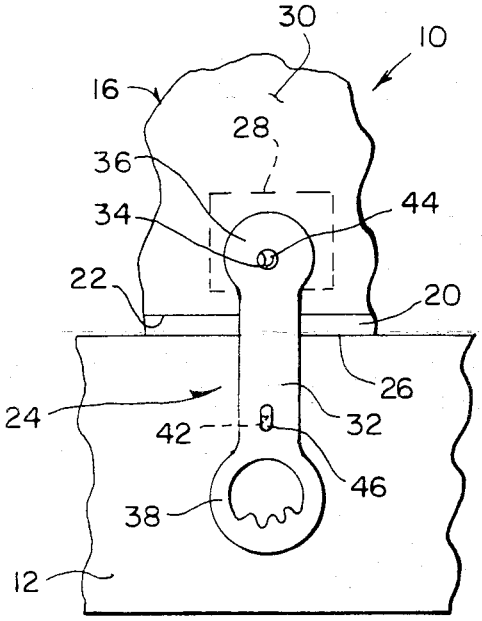
FIG. 2 is an enlarged elevational view taken along line 2—2 in FIG. 1.
Figure 3:
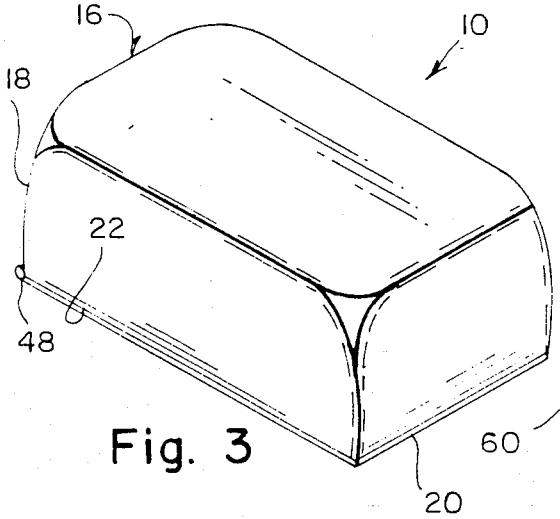
FIG. 3 is a perspective view of the cover shown in FIG. 1 thereof.

Turning now descriptively to the drawings, in which similar reference characters denote similar elements throughout the several views, FIGS. 1 through 3 illustrates a sealing cover 10 for an attic floor well opening 12 and attic stairs 14. The cover 10 consists of a dome 16 made of insulated material, covering the attic floor well opening 12 pivotable at one side 18 to close and open the attic floor well opening 12. A seal 20 made of weather stripping is mounted, such as by adhesive, around bottom edge 22 of the dome 16.

A device 24 is provided for holding down the dome 16 over the attic floor well opening 12 and compressing the seal 20 around perimeter 26 of the attic floor well opening 12 making the dome 16 draft free. The device 24 consists of a back up block 28 moulded within inner wall 30 of the dome 16. A strap 32 made of stretchable rubber material has a first transverse aperture 34 at top end 36, a hand grip handle 38 formed at bottom end 40 and a second transverse aperture 42 near the handle 38 thereof. A fastener 44, such as a rivet, is placed through the first transverse aperture 34 in the strap 32 and into the back up block 28. A hook 46 is mounted in the attic floor well opening 12 below the fastener 44 so that when the strap 32 is stretched down via the hand grip handle 38 the second transverse aperture 42 can be placed over the hook 46.

A spring hinge 48 is also provided for raising up the dome 16 from the attic floor well opening 12 so that a person (not shown) may gain access through the attic floor well opening 12 via the attic stairs 14. The spring hinge 48 is mounted at a point 50 between the bottom edge 22 of the dome 16 and the perimeter 26 of the attic floor well opening 12 opposite the back up block 28. When the second transverse aperture 42 in the strap 32 is removed from the hook 46 the spring hinge 48 will pivot the dome 16 to an open position.

Figure 4:
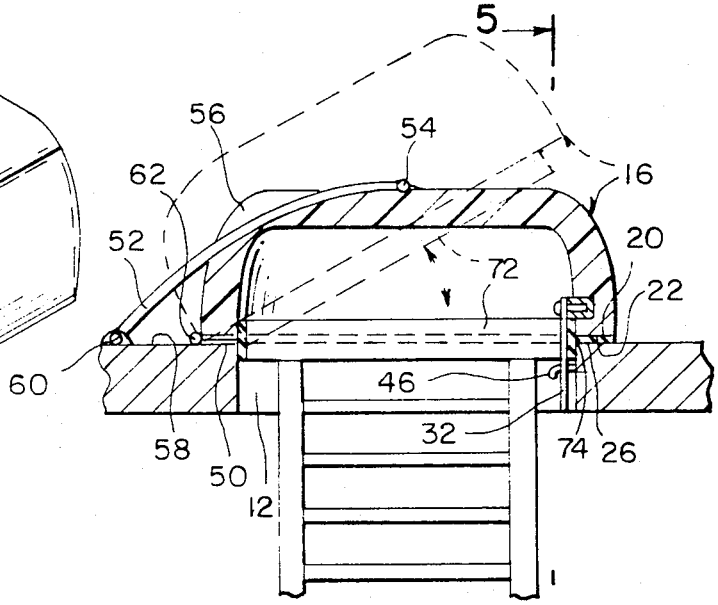
FIG. 4 is a cross sectional view similar to FIG. 1 of a modification showing another spring and seal.

In FIG. 4 a leaf spring 52 is pivotally connected between a top center point 54 within a groove 56 in the dome 16 and the attic floor 58 at 60. A hinge 62 is mounted at a point 50 between the bottom edge 22 of the dome 16 and the perimeter 26 of the attic floor well opening 12. When the second transverse aperture 42 in the strap 32 is removed from the hook 42 the leaf spring 52 will pull up the dome 16 allowing the dome 16 to pivot on the hinge 62 to an open position.

Figure 5:
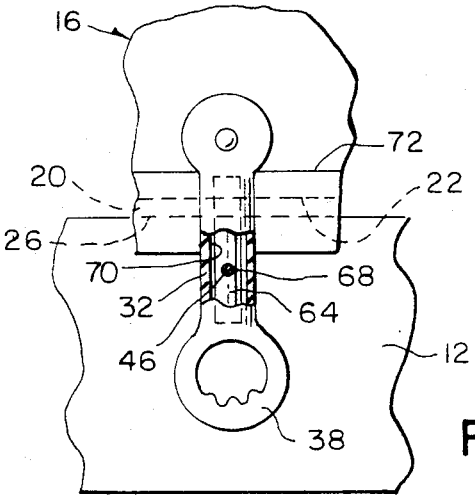
FIG. 5 is an enlarged elevational view with parts in section taken along line 5—5 in FIG. 4.

FIG. 5 shows the strap 32 further comprising a rigid bar 64 that has a transverse aperture 68. The rigid bar 64 is slidably mounted within the strap 32 at 70. The transverse aperture 68 aligns with the second transverse aperture 42 in the strap 32. When the strap 32 is removed from the hook 46 the rigid bar 64 will help push up the dome 16 via the hand grip handle 38.

The seal 20 further contains a gasket 72 formed transverse on inner portion 34 of the seal 20. When the dome 16 is in a closed position the gasket 72 will aid in keeping the dome 16 draft free from the attic floor well opening 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sealing cover for an attic floor well opening and attic stairs which comprises:

(a) a dome made of insulated material, covering the attic floor well opening, pivotable at one side to close and open the attic floor well opening;

(b) a seal made of weather stripping mounted around bottom edge of said dome;

(c) means for holding down said dome over the attic floor well opening and compressing said seal around perimeter of the attic floor well opening making said dome draft free; and (d) means for raising up said dome from the attic floor well opening so that a person may gain access through the attic floor well opening via the attic stairs, wherein said means for holding down said dome over the attic floor well opening comprises:

(a) a flexible strap mounted on the dome inner surface with grip formed at bottom end and a transverse aperture near the handle thereof;

(b) a hook mounted in the attic floor well opening below said dome so that when said strap is stretched down via the hand grip handle said transverse aperture can be placed over said hook, wherein said means for raising up said dome from the attic floor well opening is a spring hinge mounted between the bottom edge of said dome and the attic floor opposite said strap so that when said strap is removed from said hook said spring hinge will pivot said dome to an open position, wherein said means for raising up said dome from the attic floor well opening further comprises:

(c) a leaf spring pivotally connected between a top center point within a groove in said dome and a second hinge on the attic floor.

2. A sealing cover as recited in claim 1, wherein said strap further comprises a rigid bar having a hole, said rigid bar slideably mounted within said strap, the hole aligns with the transverse aperture in said strap so that when said strap is removed from said hook said rigid bar helps push up said dome via the hand grip handle.

3. A sealing cover as recited in claim 2, wherein said seal further comprises a gasket formed transversely on the inner edge of said seal so that when said dome is in a closed position said gasket will sealingly engage the transverse edge of the attic floor surrounding the well opening.

* * * * *